US006901668B2

(12) United States Patent
Elsener-Zehnder et al.

(10) Patent No.: US 6,901,668 B2
(45) Date of Patent: Jun. 7, 2005

(54) BLADE GUARD

(75) Inventors: Carl Elsener-Zehnder, Ibach (CH); Peter Balsiger-Schilter, Brunnen (CH)

(73) Assignee: Victorinox AG (CH)

( * ) Notice: Subject to any disclaimer, the term of this patent is extended or adjusted under 35 U.S.C. 154(b) by 0 days.

(21) Appl. No.: 10/454,335

(22) Filed: Jun. 4, 2003

(65) Prior Publication Data

US 2004/0244204 A1 Dec. 9, 2004

(51) Int. Cl.[7] ..... B26B 29/02; B65D 73/06

(52) U.S. Cl. ..... 30/298.4; 30/151; 30/504; 206/460; 206/813

(58) Field of Search ..... 30/298.4, 504, 30/151; 206/460, 813

(56) References Cited

U.S. PATENT DOCUMENTS 2,439,568 A * 4/1948 Hall ..... 150/161
4,369,885 A 1/1983 Redmond
5,699,907 A * 12/1997 Langenstuck ..... 206/349

FOREIGN PATENT DOCUMENTS

EP 0705769 4/1996
EP 0819618 1/1998
FR 2429722 1/1980
WO WO 89/04800 6/1989

* cited by examiner

*Primary Examiner*—Douglas D Watts
(74) *Attorney, Agent, or Firm*—Cantor Colburn LLP

(57) ABSTRACT

The disclosure includes a device for protecting a blade of a knife, scissors or the like, consisting of two largely congruent partial surfaces that are designed as one piece with one another, of which at least one contains on essentially its entire surface an adhesive and which can be glued together while sandwiching the blade in between them, wherein the two partial surfaces are connected with each other along a folding edge containing a perforation and at least one of the partial surfaces contains a projection protruding beyond the congruence area. In order to create a device for protecting a blade of a knife, scissors or the like that can be produced with little material effort and little manufacturing effort, that cannot be lost, that represents effective protection both for the blade and for people, that can simultaneously be used as information medium in the form a label and beyond that permits extensive observation and examination of the product and furthermore enables easy handling for the user and that especially while simultaneously reliably securing the blade can be removed, if required, from the blade easily and without residue, the invention suggests to use an adhesive on acrylic basis and to ensure that the partial surfaces are formed of a film and consist of polypropylene.

11 Claims, 2 Drawing Sheets

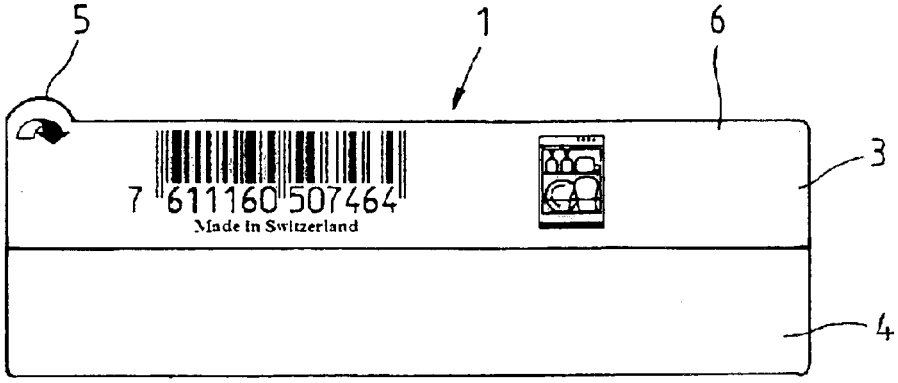
Fig. 1
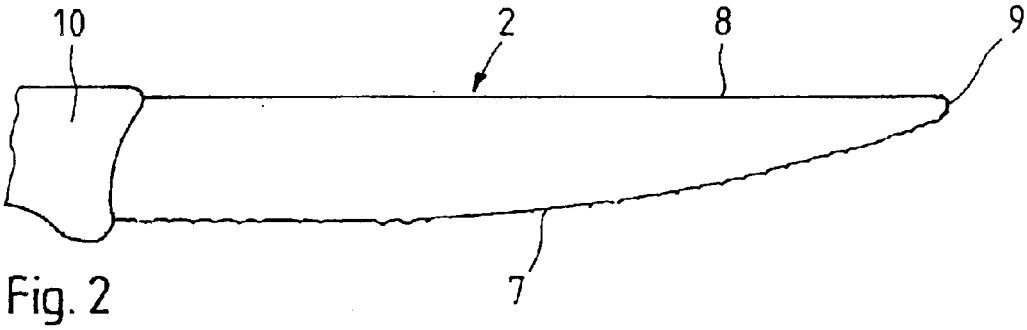
Fig. 2
Fig. 3
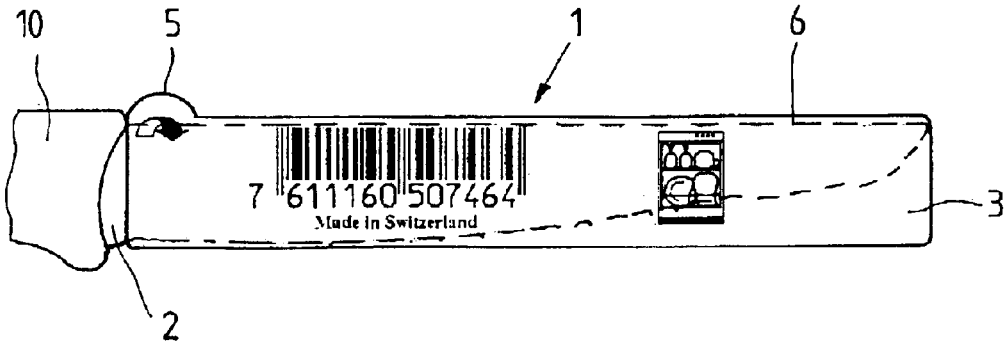
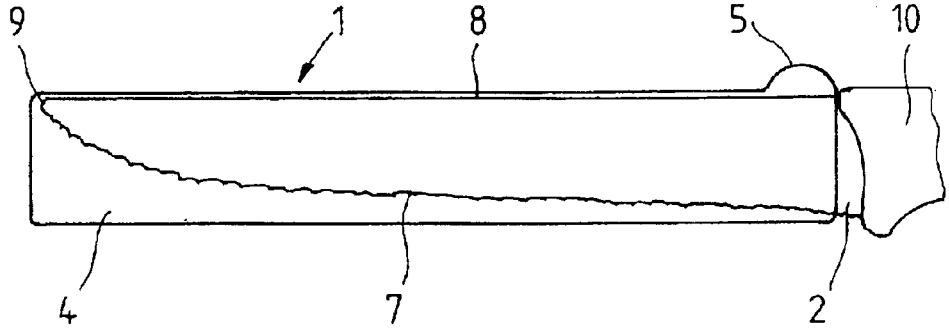
Fig. 4

BLADE GUARD

FIELD OF THE INVENTION

The present invention relates to a device for protecting a blade of a knife, scissors or the like, consisting of two largely congruent partial surfaces that are designed as one piece with one another, of which at least one contains on essentially its entire surface an adhesive and which can be glued together while sandwiching the blade in between them, wherein the two partial surfaces are connected with each other along a folding edge containing a perforation and at least one of the partial surfaces contains a projection protruding beyond the congruence area.

DESCRIPTION OF THE RELATED ART

Between the manufacturing and the sale of such products the blade must be protected on the one hand from breakage, contamination and the like and on the other hand the transport or sales staff or the sales person etc. must be protected from the cutting edge. Therefore the need for packaging of at the least the blade arises for the time between its manufacture and its use. Beyond that, the product must be equipped, labeled and marked with information in the usual manner.

From the state of the art we know of so-called knife scabbards made of various materials. For this, plastic sheaths, but also paper sheaths and the like are used. They generally imitate the blade contour and usually have very one-sided protective properties. A paper sheath or a scabbard made of soft polymer, for example, protects people from the edge, however it does not protect the blade from breaking. Beyond that, the blade can be removed easily from the scabbard for viewing purposes so that the blade itself again as well as the observer are placed at risk. Such scabbards can also be lost easily.

From EP 0 819 618 A1 we know of a packaging for a knife and the like, which encloses and protects the edge and leaves the handle free to be able to seize it, wherein a front and a self-adhesive rear film cover the blade on both sides while overlapping and wherein the overlapping areas of the film are glued together. The film ends facing the handle of the knife containing a nose for tearing the packaging open. By arranging the nose on the end of the blade, or on the transition area to the handle, this portion of the blade, which represents a frequently occurring breakage area, is not stabilized in its entirety and thus is not effectively protected.

Furthermore, we know in particular in the self-service field of blister-like packaging, where the knives, scissors and the like are welded onto a carrier with a welding film. These types of packaging are usually very unaesthetic, bulky and represent increased material expenses.

A generic device for protecting a blade, a knife, scissors or the like is known from EP 1 059 242. Although the device described here has proven itself in daily practical usage, there is still a need for a further improved protective device, especially with regard to simplified handling of the same.

SUMMARY OF THE INVENTION

Proceeding from the prior state of the art, the present invention is based on the task of providing a blade guard, which can be produced with little material effort and little manufacturing effort, which cannot be lost, offers effective protection both for the blade and for people, can be used simultaneously as information medium in the form of a label and beyond that permits the product to be viewed to a large extent and checked. The blade guard provides a protective device that enables easy handling by the user and that, if necessary, can be removed from the blade easily and completely, especially while simultaneously reliably securing the blade.

The blade guard includes an adhesive of acrylic basis and that the partial surfaces are made of a film and consist of polypropylene.

Pursuant to the invention, two essentially congruent partial surfaces that with each other form a single-piece part of which at least one contains an adhesive on its surface. Both partial surfaces are glued together while the blade is sandwiched in between. Since the surface containing the adhesive has adhesive properties on essentially its entire surface, one the two partial surfaces adhere to the other and the film also sticks to the corresponding blade surface. This way the blade guard cannot be lost from the blade before it is completely removed. Containing an adhesive on essentially the entire surface means that at least the partial surface areas protruding beyond the blade can be glued together and that in at least one area the partial surface can be glued to the blade. The partial surfaces have a contour that at least in some areas is larger than the blade contour. In particular, the blade shall be covered along the edge by protruding and glued-together partial surfaces.

Pursuant to the invention, the adhesive is an adhesive on an acrylic basis. This is beneficial not only for ecological reasons, but this way easy handling of the protective device is achieved as well because the user can pull the glued-together partial surfaces easily off the blade of the knife, scissors or the like without leaving residue. The use of an acrylic adhesive at the same time affects such a bond between the blade guard on the one hand and the blade on the other hand that the unintended removal of the blade guard, for example during transport or the like, is effectively prevented. Additionally an acrylic-based adhesive is water-soluble so that adhesive residue that may unintentionally develop on the blade can be removed without causing any, in particular visual, impairment to the blade. The use of an acrylic adhesive is also beneficial in regard to the automated packing process of the blades that are supposed to be protected because the required machinery can be maintained and cared for with comparatively little effort. Especially potential adhesive residue can be removed easily due to the water-soluble properties.

It is further provided pursuant to the invention that the partial surfaces of the blade guard are made of film and consist of polypropylene. The use of a film consisting of polypropylene is here beneficial in that it guarantees easy handling both by the manufacturer and the user as films consisting of polypropylene can be processed without warpage and with great accuracy. Due to their resistance to tearing, they also permit safe protection of the blade. Their resistance to tearing additionally guarantees that the user can seize them at the end and pull them off the blade without the risk of tearing them. The use of film consisting of polypropylene is user-friendly and permits appropriate easy handling while simultaneously safely protecting the blade. An at least partially transparent film also allows an unimpaired view of the blade that is protected by the film so that at least the visual quality check of the blade is possible even with the attached blade guard, which is beneficial especially with regard to discussions with the customer during the sale. Film consisting of polypropylene can also be imprinted easily with conventional printing methods so that consumer information can be applied directly onto the blade guard. Feasible information in this context includes manufacturer's information, quality features, pricing information, bar code identification and the like.

Pursuant to another feature of the invention, at least one of the partial surfaces comprises a projection that protrudes beyond the congruency area. Said area can serve the purpose of pulling the blade guard off the blade since the projection is easy to seize. To remove the blade guard, the user only needs to seize the projection of the blade guard and pull it in a downward motion directed at the edge of the blade, which pulls the blade guard off the blade. This way easy handling for the user is guaranteed.

Pursuant to another feature of the invention, the projection contains no adhesive. Unintentional adhesion of the projection can thus be prevented so that it is ensured beneficially in all cases that the projection is available for the intended use by the consumer. The non-adhesive design of the projection furthermore conveys a high quality of the invented blade guard, a feature the user automatically perceives.

In a beneficial design the partial areas are essentially rectangular, wherein for design reasons the edges can be rounded. Additionally, it is suggested pursuant to the invention that at least one of the partial surfaces in turn is divided into surface segments. This can be achieved, for example, by including a perforation. It is thus possible to prevent the complete easy removal of the entire blade guard. For one, this offers better effectiveness of the protector, and secondly the blade is also protected from intended manipulations. The blade guard can also be used as a sales guard device.

The blade guard can alternatively also consist of a combination of film and paper. At least one of the partial surfaces, however, is an adhesive film. It is particularly useful when both partial areas are made of a rectangular piece of adhesive film as a one-piece unit, attached to one other. The adhesive film now has to be folded around the blade and glued to it. Preferably, one of the partial surfaces is designed completely or at least partially transparent. At least one of the partial surfaces is designed as an information medium, i.e. colored, imprinted or backed. Information can be product information, manufacturer's information, pricing information or the like.

As already described, the adhesive used is preferably an easily soluble contact adhesive on acrylic basis, which is selected to meet also other marginal requirements, i.e. for example is non-toxic and the like. The adhesive properties must guarantee on the one hand safe adhesion of the blade guard to the blade and between the partial surfaces and on the other hand they must enable easy removal of the blade guard from the blade.

The invention makes a blade guard available that is easy to manufacture and effective. It can be, for example, a blade guard in label form, which can be produced with conventional means as a continuously printable form set. Such labels consisting of adhesive film can be imprinted with the appropriate information and be applied automatically to the finished blades. The blade itself is protected from breakage and contamination, the edge is covered at the same time, and people are therefore protected from unintentional cuts. By selecting a transparent partial surface area, the blade can still be viewed in its entirety, and the blade guard can be removed easily, without being easily lost.

Pursuant to another feature of the invention, the adhesive contains color pigments at least with regard to one partial surface. These color pigments serve the purpose of creating a contrast to the information that is applied onto the blade guard so that it is more easily perceived by the consumer. Possible are especially white and/or silver color pigments, but of course all other colorations depending on preference can be used. White or silver color pigments have, however, proven themselves in that they form the best perceivable contrast for the consumer in relation to a dark information imprint, for example in black.

Adding color pigments to the adhesive has proven beneficial in comparison to coloration of the film in that this way simplified handling for the manufacturer is achieved and also the use of standard films is possible. The addition of color pigments to the adhesive furthermore allows easily varied coloration to be performed by the manufacturer so that, for example, different color pigments can be used, allowing the consumer to see at first glance what type of blade and consequently what type of knife or scissors or the like is involved with the use of an accordingly colored adhesive as a function of the type, size and property of the blade that is to be protected with the blade guard. Independent of the selection of the adhesive one and the same films can be used beneficially.

Pursuant to another feature of the invention, it is provided that the partial surfaces contain an extension protruding beyond the blade end. This extension can contain, for example, a punched hole and serves the incorporation of a slot that is integrated in the blade guard. Without requiring additional aids, the blade guard designed this way can be used for the suspended storage of the knife, scissors or the like. For this purpose, the diameter of the punched hole is beneficially adjusted to the diameter of commercially used fastening or suspension elements in rod form so that the knife or the scissors or the like can be slid easily onto correspondingly designed fastening or storage rods in conjunction with the invented blade guard.

BRIEF DESCRIPTION OF THE DRAWINGS

Additional advantages and features of the invention result from the following description based on the figures. They show:

FIG. 1 a top view onto one design of a blade guard before its use;

FIG. 2 an exemplary depiction of a cutting edge;

FIG. 3 a depiction of the blade guard that has been applied onto the cutting edge;

FIG. 4 a depiction pursuant to FIG. 3 in a view on the second surface;

In the figures equivalent elements are marked with the same reference numbers.

DETAILED DESCRIPTION

Figure 5:
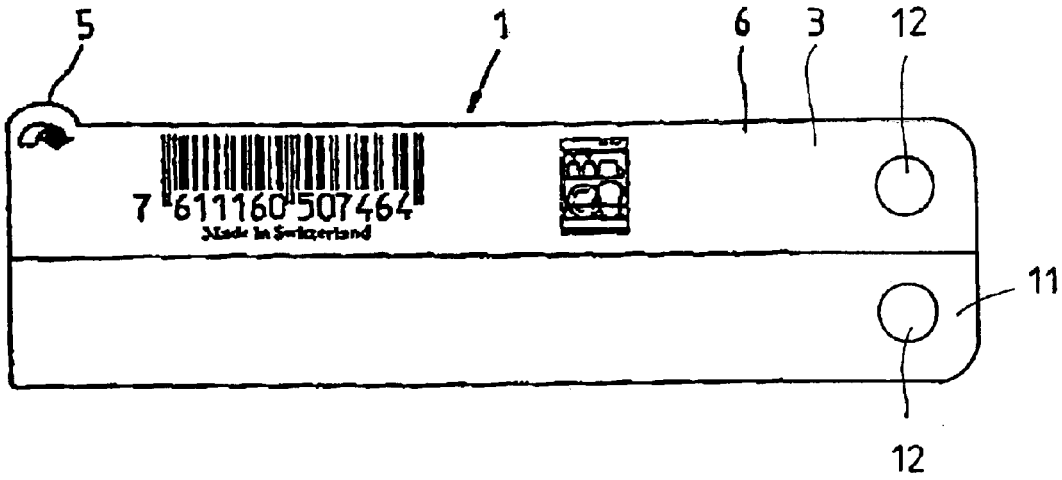
FIG. 5 a top view onto another embodiment of a blade guard before its use.

A blade guard 1 consists of an adhesive film made of a polymer or paper, which on one surface contains an easily soluble contact adhesive on its entire surface. The blade guard 1 is arranged, for example, as a plastic label on a perforated edge carrier and can thus be imprinted easily with laser printers and the like. The imprinting process creates two partial surfaces 3 and 4, wherein the partial surface 3 is imprinted with information 6, while the partial surface 4 remains as a transparent partial surface. One partial surface 3 contains a projection 5 in the depicted embodiment.

A knife blade 2 is arranged on a knife handle 10 and conventionally contains an edge 7, an upper edge 8 that extends in an essentially straight line and a tip 9.

The blade guard 1 is folded along the separating edge between the partial surfaces 3 and 4, and the two partial surfaces 3 and 4, respectively, are glued onto one of the two surfaces of the knife blade 2. The areas of the partial surfaces 3 and 4 protruding beyond the blade are glued together. The adhesion area is preferably arranged so as to cover the edge 7, while the free edges of the blade guard 1 also run along the essentially straight upper edge 8. The projection 5 protrudes from the configuration and can be easily seized and thus facilitates a pulling of the blade guard 1 off the knife blade 2. On one surface the partial surface 3 with the imprinted information 6 can be seen, on the other surface the knife blade 2 can be viewed in its entirety through the transparent partial surface 4.

Due to this arrangement of the blade guard 1 the product can be viewed and evaluated in its entirety, while the knife blade 2 is protected from contamination and breakage and the blade guard 1 represents a protection for people. By selecting a corresponding film, the assembly area protruding beyond the blade 2 between the partial surfaces 3 and 4 represents a rigid area, which does not bend under normal circumstances, so that its merchandising offers a very proper appearance from a sales promotional aspect.

The described design serves only the explanation of the invention and does not limit it. Especially the division of the surfaces can be varied. The partial surfaces do not have to be transparent across the entire surface or be imprinted across the entire surface, they do not have to be a single-piece unit and beyond that can be divided, for example, by perforations or the like into surface segments.

Figure 6:
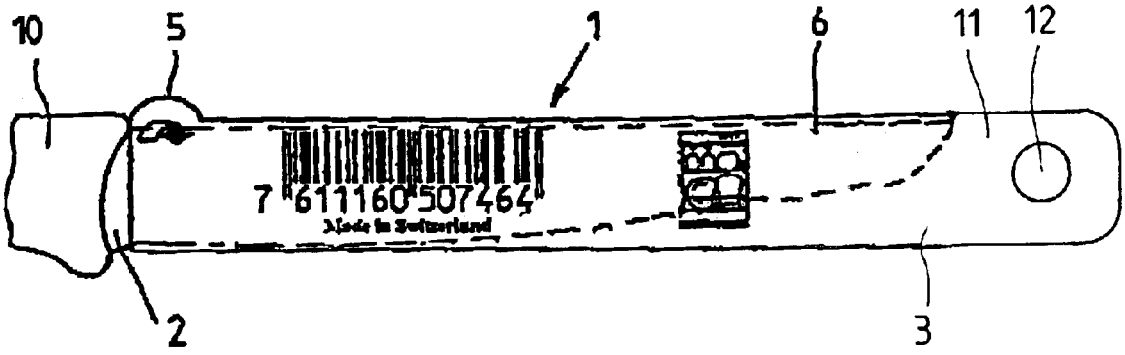
FIG. 6 a depiction of the blade guard pursuant to FIG. 5 that has been applied onto the cutting edge.

An alternative example of a design is depicted in FIGS. 5 and 6. They show a blade guard pursuant to the invention, which contains an extension 11 protruding beyond the blade end of the knife. With regard to the two partial surfaces, this extension 11 contains a hole 12, which serves as a slot for use in especially rod-shaped fastening elements. As FIG. 6 reveals, in the applied state of the blade guard the holes 12 incorporated in the partial surfaces are arranged congruent on top of each other so that a fastening element penetrating the holes 12 serves the secure suspension of both partial surfaces of the blade guard. Carried by the blade guard, the knife depicted in the figures can thus be suspended easily and without the use of additional aids in correspondingly designed sales shelves, which is of benefit especially with regard to an aesthetic presentation.

What is claimed is:

1. Device for protecting a blade of a knife, scissors or the like, the device comprising:

two substantially congruent partial surfaces which at least one contains an adhesive, wherein the two partial surfaces are connected with each other along a folding edge comprising a perforation, wherein the blade is sandwiched by the partial surfaces and wherein areas of the partial surfaces disposed proximate to the folding edge and protruding beyond a lower edge of the blade are glued together and wherein free edges of the partial surfaces run along an upper edge of said blade, and wherein at least one of the partial surfaces comprises a projection protruding beyond the congruence area, the adhesive is an acrylic basis and the partial surfaces are made of film and consist of polypropylene.

2. Device pursuant to claim 1, wherein the projection contains no adhesive.

3. Device pursuant to claim 1, wherein the adhesive contains color pigments at least with regard to one partial surface.

4. Device pursuant to claim 3, wherein the color pigments are white and/or silver color pigments.

5. Device pursuant to claim 1, wherein the partial surfaces contain an extension protruding beyond the blade end.

6. Device pursuant to claim 5, wherein the extension contains a punched hole.

7. Device pursuant to claim 1, wherein the congruence area is substantially rectangular.

8. Device pursuant to claim 1, wherein at least one of the partial surfaces is transparent.

9. Device pursuant to claim 1, wherein at least one of the partial surfaces is designed as an information medium.

10. Device pursuant to claim 1, wherein the device is imprinted in the form of continuously printable labels and can be applied automatically on finished blades.

11. Device pursuant to claim 1, wherein the two surfaces are designed as one piece.

* * * * *